US007465111B2

(12) United States Patent
Juran et al.

(10) Patent No.: US 7,465,111 B2
(45) Date of Patent: Dec. 16, 2008

(54) STACKABLE CLEANER

(75) Inventors: Robert A. Juran, Independence, OH (US); Craig M. Saunders, Rocky River, OH (US); Trevor L. Jackson, Kirtland, OH (US)

(73) Assignee: Applitech, Inc., Mayfield Village, OH (US)

( * ) Notice: Subject to any disclaimer, the term of this patent is extended or adjusted under 35 U.S.C. 154(b) by 492 days.

(21) Appl. No.: 11/108,522

(22) Filed: Apr. 18, 2005

(65) Prior Publication Data

US 2005/0238407 A1 Oct. 27, 2005

Related U.S. Application Data

(63) Continuation-in-part of application No. 10/608,048, filed on Jun. 27, 2003.

(60) Provisional application No. 60/564,322, filed on Apr. 22, 2004, provisional application No. 60/393,521, filed on Jul. 5, 2002.

(51) Int. Cl.
*B43K 27/02* (2006.01)

(52) U.S. Cl. ..... 401/18; 401/57; 401/90; 401/124; 401/202

(58) Field of Classification Search ..... 401/18, 401/57, 90, 118, 124, 202; 15/104.94, 244.1
See application file for complete search history.

(56) References Cited

U.S. PATENT DOCUMENTS

| | | | | |
|---|---|---|---|---|
| 2,645,375 | A * | 7/1953 | Topfer | 220/4.27 |
| 4,165,815 | A * | 8/1979 | Vetter | 220/4.27 |
| 4,346,495 | A * | 8/1982 | Lin | 15/184 |
| 4,595,099 | A | 6/1986 | Zaruba et al. | |
| 4,854,761 | A | 8/1989 | Smith et al. | |
| 4,998,984 | A | 3/1991 | McClendon | |
| 5,230,119 | A | 7/1993 | Woods et al. | |
| 5,344,007 | A | 9/1994 | Nakamura et al. | |
| 5,431,098 | A * | 7/1995 | Winston | 15/104.94 |
| 5,535,908 | A | 7/1996 | Sheu | |
| 5,765,407 | A * | 6/1998 | Choo et al. | 401/18 |
| 6,604,879 | B2 * | 8/2003 | Gueret | 401/190 |
| 2001/0047951 | A1 * | 12/2001 | O'Connor | 206/575 |
| 2004/0003477 | A1 * | 1/2004 | Juran et al. | 15/104.94 |
| 2004/0052568 | A1 * | 3/2004 | Gueret | 401/118 |

FOREIGN PATENT DOCUMENTS

| | | | |
|---|---|---|---|
| EP | 0357276 | A1 * | 3/1990 |
| FR | 1395292 | | 5/1964 |

* cited by examiner

*Primary Examiner*—Khoa D Huynh
(74) *Attorney, Agent, or Firm*—Fay Sharpe LLP; Karl W. Hauber

(57) ABSTRACT

A stackable cleaner or product applicator is described in which a rigid applicator body has a downwardly opening compartment surrounded by a skirt and an upper compartment surrounded by an upwardly extending wall, the upper compartment containing a foam body and fluid or gel and being closed by means of a removable top wall fixed to the top periphery of the upwardly extending wall. The removable top has a tab to aid opening. The downwardly extending skirt is sized to accept the upwardly extending wall of an identical unit whereby multiple units may be stacked in a nested configuration. A cap is provided to cover the top of the uppermost cleaner in a stack. The cap has an opening adapted to engage the removable top tab and act as a lever for easy opening.

25 Claims, 6 Drawing Sheets

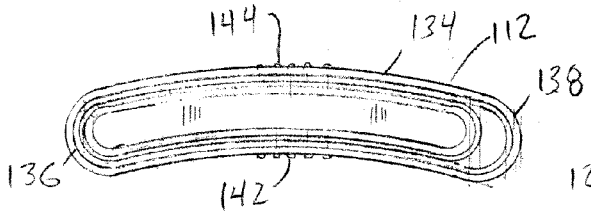
FIG. 18
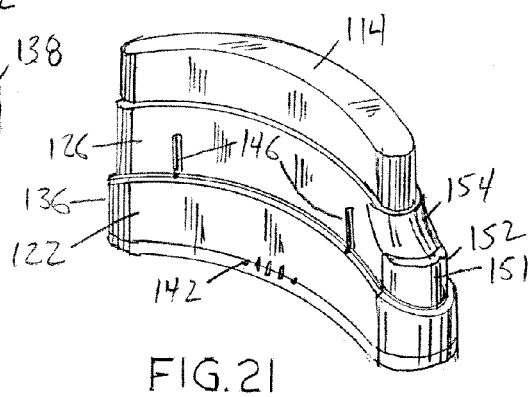
FIG. 21
FIG. 17
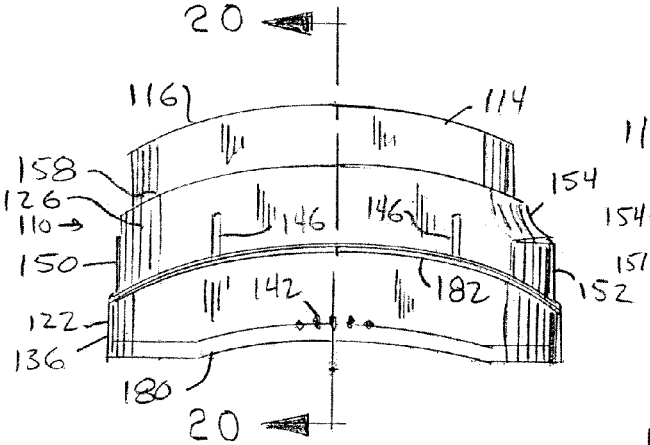
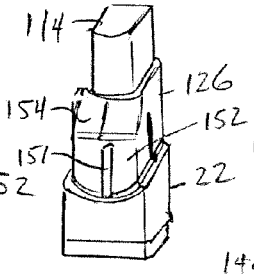
FIG. 19
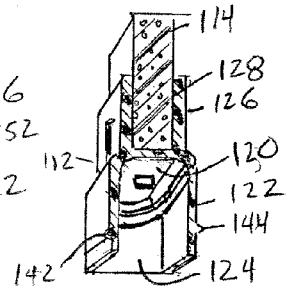
FIG. 20
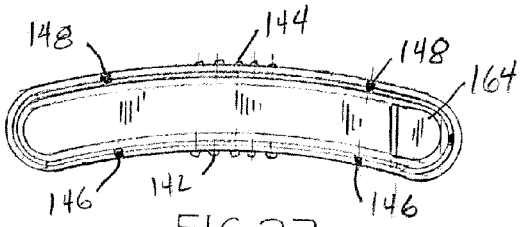
FIG. 23
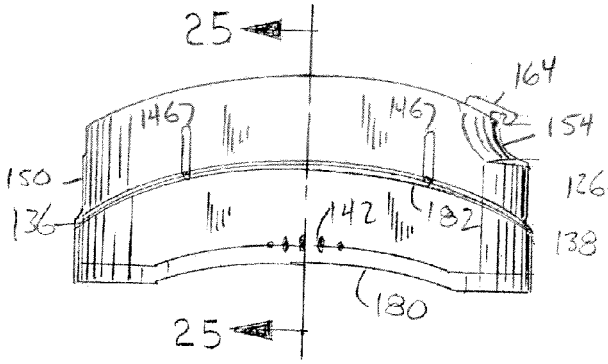
FIG. 22
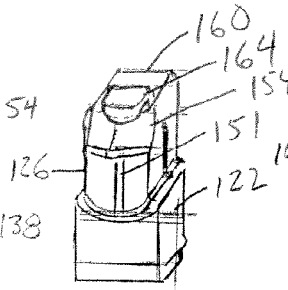
FIG. 24
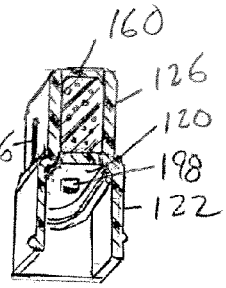
FIG. 25

STACKABLE CLEANER

This application claims the benefit of U.S. Provisional patent application Ser. No. 60/564,322, filed Apr. 22, 2004, and is also a Continuation-in-Part application of U.S. patent application Ser. No. 10/608,048, filed Jun. 27, 2003, which, in turn claims priority to U.S. Provisional Patent application Ser No. 60/393,521, filed Jul. 5, 2002.

BACKGROUND OF THE INVENTION

This invention relates to a combined disposable rigid container and cleaner. More particularly the invention relates to a rigid stackable package including a sealed upper compartment containing a sponge and a quantity of cleaning fluid and a lower compartment surrounded by a skirt accepting the upper compartment of an identical unit whereby multiple units can be stacked into a retail product.

Consumers encounter surfaces they wish to clean on a regular basis. This is especially true when a person is traveling, not at home or away from home. Toilet seats in public restrooms are prime examples. However, other surfaces upon which one sits or places valuable or delicate possessions also fall into this category. One can wipe such surfaces with a tissue but such a procedure is not always satisfactory. Even if one wets a tissue or paper towel and applies soap or another cleaning agent, one is still doing less than optimal cleaning and is likely to get dirt on one's hand from the tissue or paper towel.

SUMMARY OF THE INVENTION

The present invention provides a relatively rigid applicator body having a horizontal base wall, a downwardly extending skirt, an upwardly extending side wall and a top wall. The horizontal base wall, the upwardly extending side wall and the top wall define an upper compartment. A compressible foam body sized to extend beyond the upper compartment in a relaxed state is sealed into the upper compartment along with a quantity of cleaning fluid. In one embodiment, the top wall is a sealing film. The sealing film is a sheet sealed around the entire periphery of the upper compartment and has a tab extending beyond the upper compartment periphery allowing the user to remove the seal when desired. Several of these identical units are stacked and a cap placed over the top unit forming a retail product. The applicator bodies have two long sides and shorter ends with the long sides being gently curved and parallel to one another providing an overall shape for the finished product which is easily carried in a pocket, purse or brief case.

In accordance with the present invention, the applicator body of the product is fabricated from rigid plastic material.

Still further in accordance with the present invention, the foam body contained in the applicator rigid body has a width dimension slightly greater than the width dimension of the compartment in which it is contained whereby a slight interference fit is created.

Still further in accordance with the invention, the foam body is cut from a sheet material giving the foam body blanks a generally rectangular, flat, shape.

Yet further in accordance with the invention, the upwardly extending side wall surrounding the upper compartment has a shoulder at one end creating a contained volume when mated with the skirt of a mating unit, said volume accommodating the tab of the sealing film.

It is the principal object of the present invention to provide a cleaner or applicator product comprising an applicator pad or sponge sealed within a rigid applicator body which can be easily and safely stored, easily opened and in which the applicator body functions as a rigid handle for the sponge in use.

It is another object of the present invention to provide a combined container and cleaner allowing one to use the applicator product to clean a surface without touching the surface or the pad or sponge during this operation.

It still a further object of the present invention to provide a applicator body which is rigid, durable, not subject to puncture or failure by compression, pleasing in appearance, easy to open, water tight and stackable.

Another object of the present invention is to provide a cleansing tool which is easy to open.

It still another object of the present invention to provide a cleaner which is economical to manufacture, pleasing in appearance, easy to carry and easy to use.

These and other objects of the present invention will become apparent to those skilled in the art from the following description taken in conjunction with the accompanying drawings wherein:

FIG. 17 is a front elevational view of a stackable applicator or cleaner in accordance with another embodiment of the present invention in the ready to use configuration;

FIG. 18 is a top view of the stackable applicator or cleaner of FIG. 17;

FIG. 19 is a side view of the stackable applicator or cleaner of FIGS. 17 and 18;

FIG. 20 is cross-sectional view of the applicator or cleaner of FIGS. 17-19 taken along line 20-20 of FIG. 17;

FIG. 21 is a perspective view of the applicator or cleaner of FIGS. 17-21;

FIG. 22 is a front elevational view of the stackable applicator or cleaner of FIGS. 17-20 in the sealed configuration with the sponge restrained by a top;

FIG. 23 is a top view of the stackable applicator or cleaner of FIG. 17 in the sealed configuration;

FIG. 24 is a side elevational view of the stackable applicator or cleaner of FIG. 17 in the sealed configuration;

FIG. 25 is a cross-sectional view of the applicator or cleaner of FIG. 17 in the sealed configuration taken along line 25-25 of FIG. 22;

PREFERRED EMBODIMENT

Figure 2:
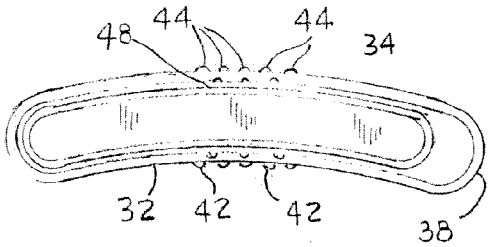
FIG. 2 is a top view of the stackable applicator or cleaner of FIG. 1.
Figure 5:
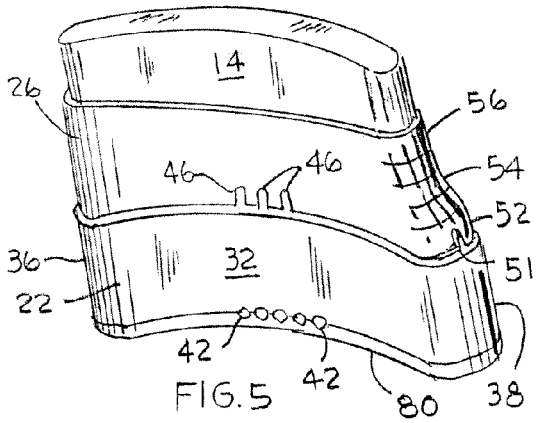
FIG. 5 is a perspective view of the applicator or cleaner of FIGS. 1-4.
Figure 1:
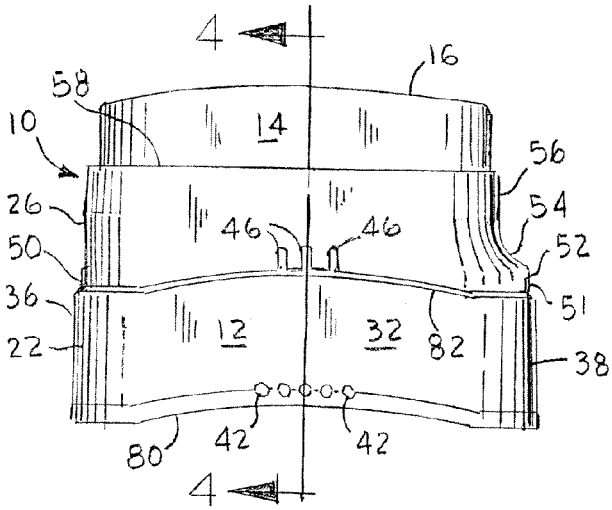
FIG. 1 is a front elevational view of a stackable applicator or cleaner in accordance with the present invention in the ready to use configuration.
Figure 3:
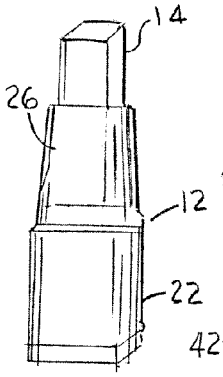
FIG. 3 is a side view of the stackable applicator or cleaner of FIGS. 1 and 2.
Figure 4:
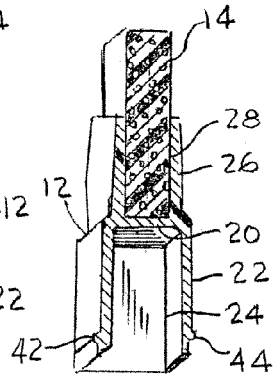
FIG. 4 is cross-sectional view of the applicator or cleaner of FIGS. 1-3 taken along line 4-4 of FIG. 1.
Figure 7:
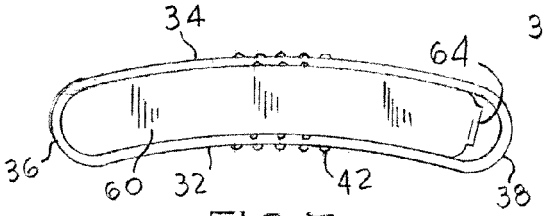
FIG. 7 is a top view of the stackable applicator or cleaner in the sealed configuration.
Figure 10:
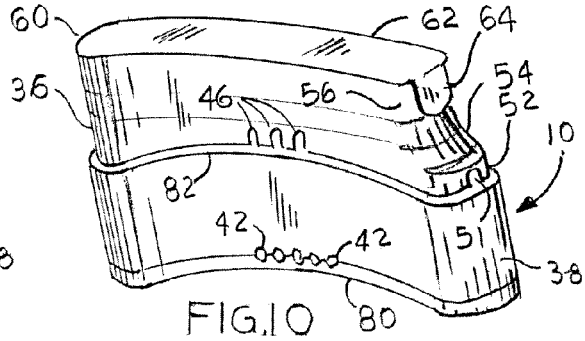
FIG. 10 is a perspective view of the applicator or cleaner seen in FIGS. 1-9 in the sealed configuration.

Referring now to the drawings wherein the showings are for the purposes of illustrating preferred embodiments of the invention and not for the purposes of limiting same, FIG. 1 shows a cleaner or applicator unit 10 in accordance with the invention. The applicator unit 10 comprises a applicator rigid body 12, a foam body 14 and a quantity of fluid 16 absorbed in the foam body 14. Alternatively, the fluid 16 can be a gel or paste for use in cleaning or other applications such as polishing. Referring now to FIG. 4, the applicator rigid body 12 comprises a horizontal wall 20, a skirt 22 extending downwardly from the horizontal wall 20 and surrounding a lower compartment 24, and an upwardly extending wall 26 surrounding an upper compartment 28 in which the foam body 14 is partially disposed. As can be seen in FIG. 2, the rigid body 12 has a slightly concave front 32, a slightly convex back 34, an arcuate left end 36 and an arcuate right end 38. The front 32 and back 34 are generally parallel to one another. The applicator rigid body 12 is slightly greater than 2.5 inches wide from the left end 36 to the right end 38 and approximately one half inch deep from the outside of the front 32 to the back 34. The overall depth dimension is somewhat greater than one half inch because the front wall and back wall are both curved. The skirt 22 has a generally uniform profile extending uniformly across the front 32, the back 34, the left end 36 and the right end 38 of the applicator rigid body 12. The skirt profile is a generally planar downwardly extending wall with a slight amount of draft to accommodate the manufacturing process, injection molding. Five bumps 42 protrude from the outer surface of the front of the skirt near its bottom center. Similarly, five bumps 44 protrude from the outer surface of the center of the back 34 near its bottom. The bumps 42, 44 are tactile cues easing gripping of the applicator rigid body 12 by a user.

The upwardly extending wall 26 has a generally uniform profile across the front 32, around the left end 36 and across the back 34. The profile of the upwardly extending wall is that of a wall having two generally planar sides slightly tapering toward one another in the upward direction to accommodate the injection molding process. Three vertically orientated ridges 46 are provided near the bottom of the center of the front of the outside surface of the upwardly extending wall. Similarly, three ridges 48 are provided on the outer lower surface of the back of the upwardly extending wall 26.

The right end of the upwardly extending wall 26 has a profile differing from the remaining portions of the upwardly extending wall 26. The right end profile has a short bottom portion 52 extending generally vertically, an inwardly extending sloped shoulder portion 54 and an upper vertically extending portion 56.

An upwardly extending ridge 50 is provided at the lower extremity of the outside surface of the left end of the upwardly extending wall 26. An identical ridge 51 is provided on the bottom of the right shoulder 52. The top edge 58 of the upwardly extending wall 26 is flat and smooth around its entire periphery.

The foam body 14 conforms to the shape of the upper compartment 28. Preferably, the foam body 14 is a rectangular piece of foam or sponge cut from sheet material. In the preferred embodiment, the sheet material is approximately a quarter of an inch thick, slightly thicker than the width of the upper compartment 28. The foam body 14 is placed in the upper compartment 28 and, preferably, is adhered to the top of the horizontal wall 20. As can be seen in FIGS. 1-5, and 17 when the foam body 14 uncompressed, it extends beyond the top edge 58 of the applicator rigid body 12. In this configuration, a consumer can grasp the applicator rigid body 12 and use it to clean a surface by rubbing the portion of the foam body 14 extending from the upper compartment 28 over the surface. The fluid 16 or gel, which is preferably an isopropanol solution, cleans the surface in question.

Figure 6:
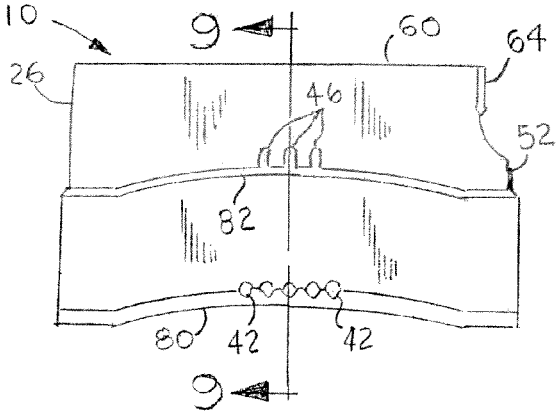
FIG. 6 is a front elevational view of the stackable applicator or cleaner of FIGS. 1-5 in the sealed configuration with the sponge restrained by a sealing film.
Figure 8:
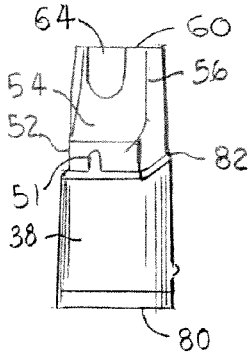
FIG. 8 is a side elevational view of the stackable applicator or cleaner in the sealed configuration.

Prior to use, the foam body is retained completely within the upper compartment 28. Referring now to FIGS. 6-10, the cleaner or applicator 10 is shown in the sealed configuration. A top wall, in this embodiment, a sealing film 60, extends over the top of the upper compartment 28 of the applicator rigid body 12. The sealing film 60 is sealed to the top edge 58 of the upwardly extending wall 26. While the sealing film 60 can be fixed to the top edge 58 by any suitable means, it is preferred to heat seal the sealing film 60 to the top edge 58. Heat sealing materials and techniques are well known in the industry and widely used on food containers (e.g. yogurt containers) and are readily available in commerce. The sealing film 60 has a closure portion 62 and a tab 64. The closure portion 62 is identical in shape to the top edge 58 of the upwardly extending wall 26 surrounding the upper compartment 28. The tab 64 extends outwardly from the closure portion 62 at the right end 38 of the applicator 12. The tab 64 is bent downwardly and lays along the right end 38 of the upwardly extending wall 26. As can be seen in FIG. 6, because the right end of the upwardly extending wall 26 includes a shoulder portion 54, there is room for the tab 64.

Figure 9:
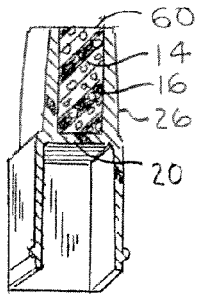
FIG. 9 is a cross-sectional view of the applicator or cleaner in the sealed configuration taken along line 9-9 of FIG. 6.

Referring now to FIG. 9, one sees that the upper compartment 28 is surrounded by the horizontal wall 20, the upwardly extending wall 26 and the sealing film 60 creating a hermetically sealed compartment. The foam body 14 and a fluid 16 or gel are contained within the sealed upper compartment 28. The fluid or gel 16 can not evaporate.

A plug or stopper can be used in place of the sealing film 60. The stopper, not shown, has a flat, horizontal surface having a shape identical to the inner edge of the upwardly extending wall 26 plus a tab extending above the shoulder 54. A stopper skirt extends downwardly from the stopper horizontal surface and engages the inside of the upwardly extending wall 26. A horizontal ridge extends around the periphery of the skirt and engages a mating recess in the inside surface of the upwardly extending wall 26, holding the stopper in place. The upper compartment is opened by grasping the tab and removing the stopper. The stopper is, in effect, a removable top wall just as the film 60 is a removable top wall.

Figure 11:
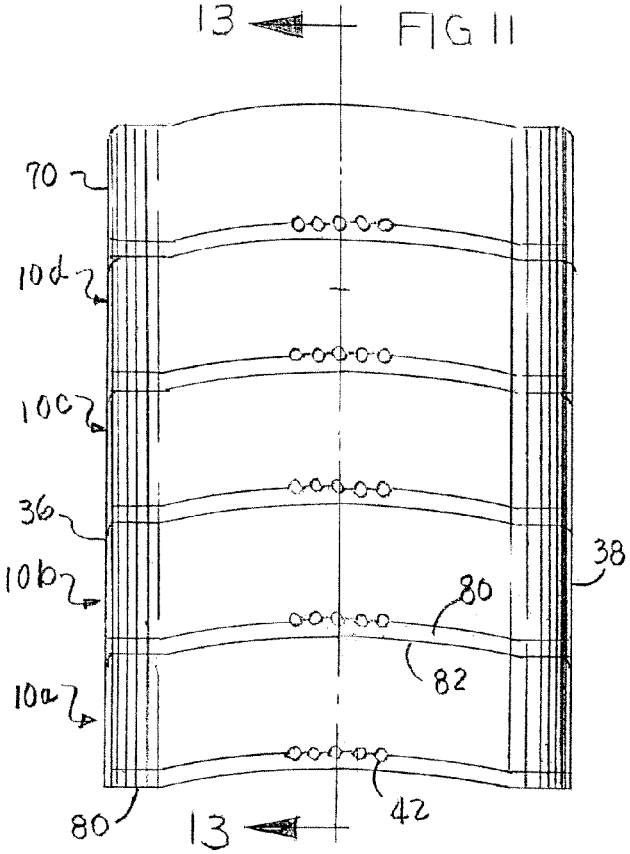
FIG. 11 is a front elevational view of a stack of applicator or cleaner as seen in FIGS. 1-10 with a cap.
Figure 12:
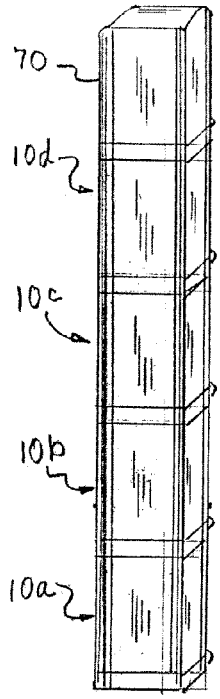
FIG. 12 is a side elevational view of the stack of FIG. 11.
Figure 13:
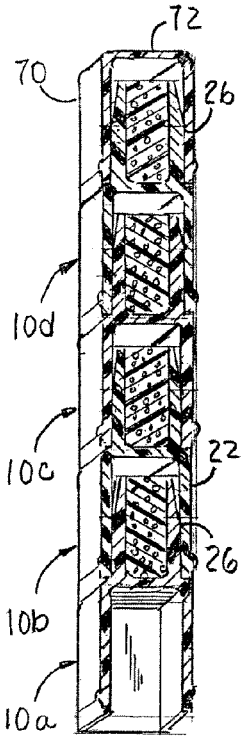
FIG. 13 is a cross-section of the stack of applicator or cleaner seen in FIG. 11 taken along line 11-11.
Figure 14:
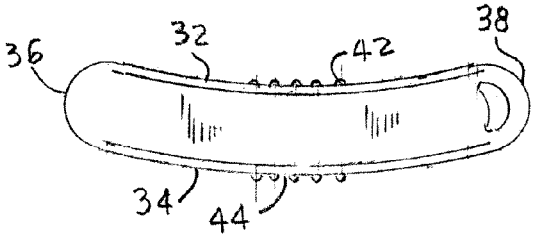
FIG. 14 is a bottom view of the stack of applicator or cleaner seen in FIGS. 11-13.
Figure 15:
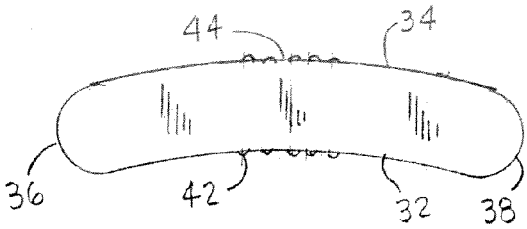
FIG. 15 is a top view of the stack of applicator or cleaner seen in FIGS. 11-14.
Figure 16:
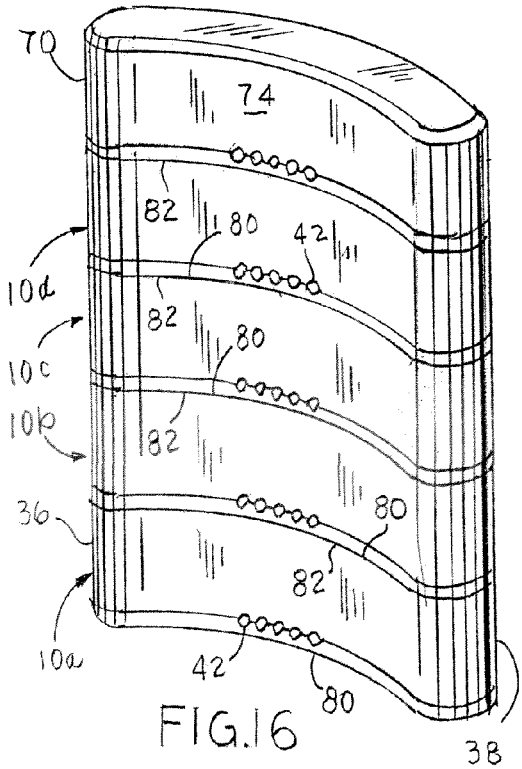
FIG. 16 is a perspective view of the stack of applicator or cleaner seen in FIGS. 11-15.

Referring now to FIGS. 11-13, a stack of four identical cleaners or applicators 10*a*, 10*b*, 10*c*, 10*d* in the sealed condition is illustrated. The stack of cleaners is shown in cross section in FIG. 13. It can be seen that the upwardly extending wall 26 of the lowest unit extends into and is surrounded by the downwardly extending skirt 22 of the next higher unit. This is true for each of the units save the topmost unit. For the topmost unit, the upwardly extending wall 26 is contained within a cap 70. The cap 70 comprises a horizontal wall 72 and a downwardly extending skirt 74. The horizontal wall 72 is identical to the horizontal wall 20 of the applicator body 12. The skirt 74 is identical to the skirt 22 of the applicator body 12. Thus, the upwardly extending wall 26 of the top most unit 10*d* extends into and is surrounded by the skirt 74 of the cap 70. In this nested configuration, the ridges 46, 48, 50, 51 on the outside of the upwardly extending wall 26 wedge against the inner surface of the skirt 22 of the next higher unit holding the ensemble together.

As can be seen in FIGS. 1, 6, and 11, the bottom edge 80 of the skirt 22 is not straight and flat. Rather, the bottom edge of the left end and right end of the skirt 22 are flat and the bottom edge of the front and back of the skirt are slightly concave. This shape is matched by the top edge 82 of the skirt so that adjacent applicators 10*a*, 10*b*, 10*c* and 10*d* mate together with an aesthetically pleasing close edge and a central curve.

The assembled multi-unit stack of applicator or cleaner units 10*a*-10*d* with the cap 70 is sold as a unit and is conveniently packable by the consumer. The entire assembly is only slightly greater than four inches in height, two and two-thirds inch in width and two thirds inches thick. Moreover, the sidewalls of the entire stack of unit are curved and conveniently rest in a person's pocket. Applicator rigid bodies 12 are rigid and nested. The sealed upper compartments 28 containing the fluid or gel are well protected. Two rigid walls, the upwardly extending wall 26 and the skirt of an adjacent unit 22 or of the cap 74, protect each upper compartment 28. The upper compartments are therefore exceedingly unlikely to be compressed to bursting or to be punctured as might be the case of a moistened wipe packed in foil envelope.

In use, a consumer buys the commercial stack as shown in FIGS. 11-14 and places the stack in a pocket, purse or other carry bag. When the consumer encounters a surface to be cleaned, he simply removes the bottom unit 10*a* or top unit 10*d* (replacing the cap on the remaining units). He can put the remaining units away and pull the tab 64 to remove the top film 60 on the selected applicator or cleaner unit 10. This releases the foam body 14 which extends outwardly from the top of the upper compartment 28 and is available for swabbing the intended surface. The user can swab the surface while maintaining a sure grip on the applicator rigid body 12. The applicator 10 is then discarded in a convenient receptacle and the fluid or gel solution used to swab the selected surface evaporates.

The unit 10 described above is manufactured by injection molding an appropriate plastic such as polypropylene into the applicator rigid body 12 and cap 70. Adhesive is applied to the top surface of the horizontal wall 20 or the bottom surface of the foam body 14 and the foam body 14 inserted into the upper compartment 28. Fluid or gel 16 is applied to the foam body 14 and the sealing film 60 applied over the foam body 14 compressing it into the upper compartment 28 bringing the sealing film closure portion 62 into contact with the top edge 58 of the upwardly extending wall 26. The sealing film 60 is then sealed to the top edge 58 by known heat sealing techniques. A completed unit 10 is thus manufactured. Several of the unit are then stacked as seen in FIG. 11 and packaged for sale at retail. Of course, fluids, gels and pastes other than cleaning fluids can be used. Surface treatments such as vinyl protectors, shoe polishes, topical medications, or other materials can be applied to the foam body 14 and sealed into the upper compartment 28. A clean, and if needed, sterile product applicator is provided in a convenient multiple unit package.

Another embodiment of the invention is shown in FIGS. 17-34. Referring to FIG. 17, the applicator unit 110 comprises a applicator rigid body 112, a compressible foam body 114 and a quantity of fluid 116 absorbed in the foam body 114. Alternatively, the fluid 116 can be a gel or paste for use in cleaning or other applications such as polishing. Referring now to FIG. 20, the applicator rigid body 112 comprises a horizontal base wall 120, a skirt 122 extending downwardly from the horizontal base wall 120 and defining a lower compartment 124, and an upwardly extending wall 126 defining an upper compartment 128 in which the foam body 114 is partially disposed. The horizontal base wall is fabricated as a separate piece and ultimately jointed to the skirt 122 and upwardly extending wall 126 as will be described hereinafter.

As can be seen in FIG. 18, the rigid body 112 has a slightly concave front 132, a slightly convex back 134, an arcuate left end 136 and an arcuate right end 138. The front 132 and back 134 are generally parallel to one another. The applicator rigid body 112 is slightly greater than 2.5 inches wide from the left end 136 to the right end 138 and approximately one half inch deep from the outside of the front 132 to the back 134. The overall depth dimension is somewhat greater than one half inch because the front wall and back wall are both curved. The skirt 122 has a generally uniform profile extending uniformly across the front 132, the back 134, the left end 136 and the right end 138 of the applicator rigid body 112. The skirt profile is a generally planar downwardly extending wall with a slight amount of draft to accommodate the manufacturing process, injection molding. Five bumps 142 protrude from the outer surface of the front of the skirt near its bottom center. Similarly, five bumps 144 protrude from the outer surface of the center of the back 134 near its bottom. The bumps 142, 144 are tactile cues easing gripping of the applicator rigid body 112 by a user.

The upwardly extending wall 126 has a generally uniform profile across the front 132, around the left end 136 and across the back 134. The profile of the upwardly extending wall is that of a wall having two generally planar sides slightly tapering toward one another in the upward direction to accommodate the injection molding process. Two vertically orientated ridges 146 are provided near the bottom of the front of the outside surface of the upwardly extending wall. Similarly, two ridges 148 are provided on the outer lower surface of the back of the upwardly extending wall 126.

The right end of the upwardly extending wall 126 has a profile differing from the remaining portions of the upwardly extending wall 126. The right end profile has a short bottom portion 152 extending generally vertically, and an inwardly extending sloped shoulder portion 154. An upwardly extending ridge 150 is provided at the lower extremity of the outside surface of the right end of the upwardly extending wall 126. An identical ridge 151 is provided on the bottom of the right shoulder 152. The top edge 158 of the upwardly extending wall 126 is open in the configuration seen in FIGS. 17-21.

The foam body 114 conforms to the shape of the upper compartment 128. Preferably, the foam body 114 is a rectangular piece of foam or sponge cut from sheet material. In the preferred embodiment, the sheet material is approximately a quarter of an inch thick, slightly thicker than the width of the upper compartment 128. The foam body 114, preferably, adhered to the top of the horizontal wall 120. As can be seen in FIGS. 17-21, when the foam body 114 uncompressed, it extends beyond the top edge 158 of the applicator rigid body 112. In this configuration, a consumer can grasp the applicator rigid body 112 and use it to clean a surface by rubbing the portion of the foam body 114 extending from the upper compartment 128 over the surface. The fluid 116 or gel, which is preferably an isopropanol solution, cleans the surface in question.

Figure 26:
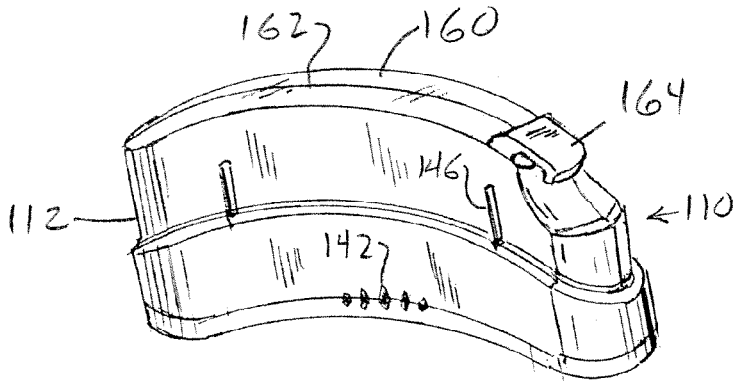
FIG. 26 is a perspective view of the applicator or cleaner seen in FIGS. 17-25 in the sealed configuration.
Figure 28:
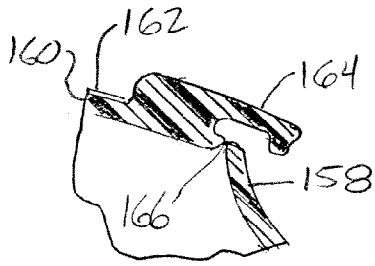
FIG. 28 is an enlarged detail view of the top of the sidewall, the top and the tab of the applicator or cleaner seen in FIGS. 17-27.

Prior to use, the foam body is retained completely within the upper compartment 128. Referring now to FIGS. 22-27, the cleaner or applicator 110 is shown in the sealed configuration. A top wall 160 extends over the top of the upper compartment 128 of the applicator rigid body 112. The top wall 160 is fixed to the top edge 158 of the upwardly extending wall 126. The top wall 160, the upwardly extending wall 126 and the skirt 122 are integrally formed in an injection molding process. The top wall 160 is joined around its entire periphery to the top edge 158 of the upwardly extending wall 126 by a very thin web 166, a portion of which is seen in FIG. 28. The top wall 160 has a closure portion 162 and a tab 164. The closure portion 162 is identical in shape to the top of the upper compartment 128 and closes the top completely. The tab 164 extends outwardly from the closure portion 162 at the right end 138 of the applicator 112. The tab 164 extends outwardly over the shoulder 154 at right end 138 of the upwardly extending wall 126. As can be seen in FIG. 26, because the right end of the upwardly extending wall 126 includes a shoulder portion 154, there is room for the tab 164.

Referring now to FIG. 25, one sees that the upper compartment 128 is enclosed by the horizontal wall 120, the upwardly extending wall 126 and the top wall 160 creating a hermetically sealed compartment. The foam body 114 and a fluid 116 or gel are contained within the sealed upper compartment 128. The fluid or gel 116 can not evaporate.

Figure 29:
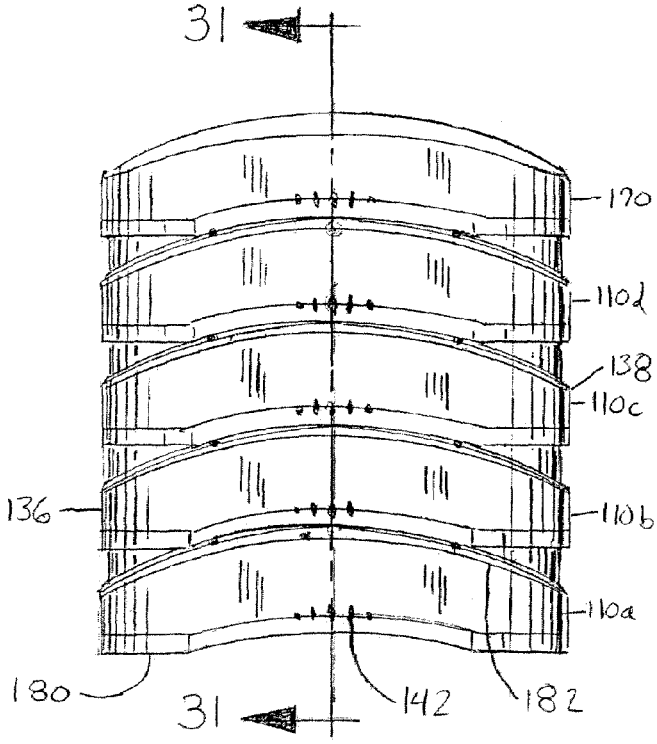
FIG. 29 is a front elevational view of a stack of applicators or cleaners as seen in FIGS. 17-28 with a cap.
Figure 30:
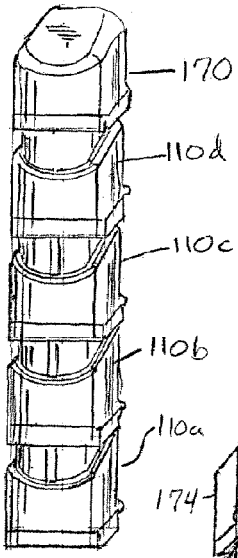
FIG. 30 is a side elevational view of the stack of FIG. 29.
Figure 31:
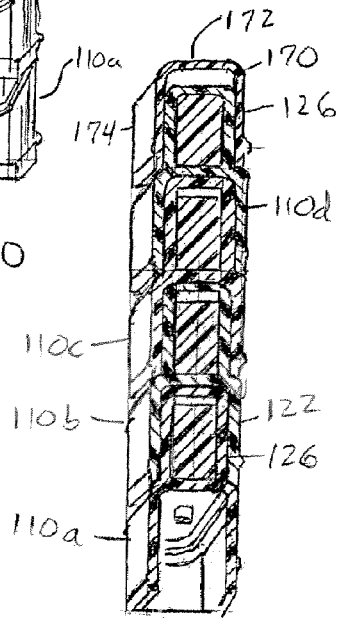
FIG. 31 is a cross-section of the stack of applicators or cleaners seen in FIG. 29 taken along line 31-31.
Figure 32:
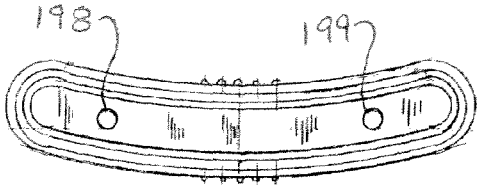
FIG. 32 is a bottom view of the stack of applicators or cleaners seen in FIGS. 29-31.

Referring now to FIGS. 29-31, a stack of four identical cleaners or applicators 110*a* , 110*b* , 110*c* ,110*d* in the sealed condition is illustrated. The stack of cleaners is shown in cross section in FIG. 31. It can be seen that the upwardly extending wall 126 of the lowest unit extends into and is surrounded by the downwardly extending skirt 122 of the next higher unit. This is true for each of the units save the topmost unit 110*d*. For the topmost unit, the upwardly extending wall 126 is contained within a cap 170. The cap 170 comprises a horizontal wall 172 and a downwardly extending skirt 174. The horizontal wall 172 is identical in shape to the horizontal wall 120. The skirt 174 is identical to the skirt 122 of the applicators 110. Thus, the upwardly extending wall 126 of the top most unit 110*d* extends into and is surrounded by the skirt 174 of the cap 170. In this nested configuration, the ridges 146, 148, 150, 151 on the outside of the upwardly extending wall 126 wedge against the inner surface of the skirt 122 of the next higher unit holding the ensemble together.

As can be seen in FIGS. 17, 21, and 29, the bottom edge 180 of the skirt 122 is not straight and flat. Rather, the bottom edges of the left end and right ends of the skirt 122 are flat and the bottom edges of the front and back of the skirt are slightly concave. This shape is matched by the top edge 182 of the skirt so that adjacent applicators 110*a*, 110*b*, 110*c* and 110*d* mate together with an aesthetically pleasing close edge and a central curve.

The assembled multi-unit stack of applicator or cleaner units 10*a*-10*d* with the cap 170 is sold as a unit and is conveniently packable by the consumer. The entire assembly is only slightly greater than four inches in height, two and two-thirds inch in width and two thirds inches thick. Moreover, the sidewalls of the entire stack of unit are curved and conveniently rest in a person's pocket. Applicator rigid bodies 112 are rigid and nested. The sealed upper compartments 128 containing the fluid or gel are well protected. Two rigid walls, the upwardly extending wall 126 and the skirt of an adjacent unit 122 or of the cap 174, protect each upper compartment 128. The upper compartments are therefore exceedingly unlikely to be compressed to bursting or to be punctured as might be the case of a moistened wipe packed in foil envelope.

Figure 34:
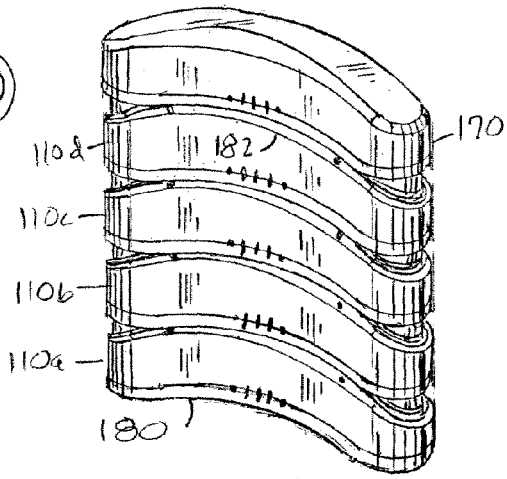
FIG. 34 is a perspective view of the stack of applicators or cleaners seen in FIGS. 29-33.

In use, a consumer buys the commercial stack as shown in FIGS. 29 and 34 and places the stack in a pocket, purse or other carry bag. When the consumer encounters a surface to be cleaned, he simply removes the bottom unit 110*a* or top unit 110*d* (replacing the cap on the remaining units). He can put the remaining units away and pull the tab 164 to tear the web joining the top wall 160 to the upwardly extending wall 126, on the selected applicator or cleaner unit 110. This separates the top wall 160 from the rigid body 112 and releases the foam body 114 which extends outwardly from the top of the upper compartment 128 and is available for swabbing the intended surface. The user can swab the surface while maintaining a sure grip on the applicator rigid body 112. The applicator 110 is then discarded in a convenient receptacle and the fluid or gel solution used to swab the selected surface evaporates.

Figure 27:
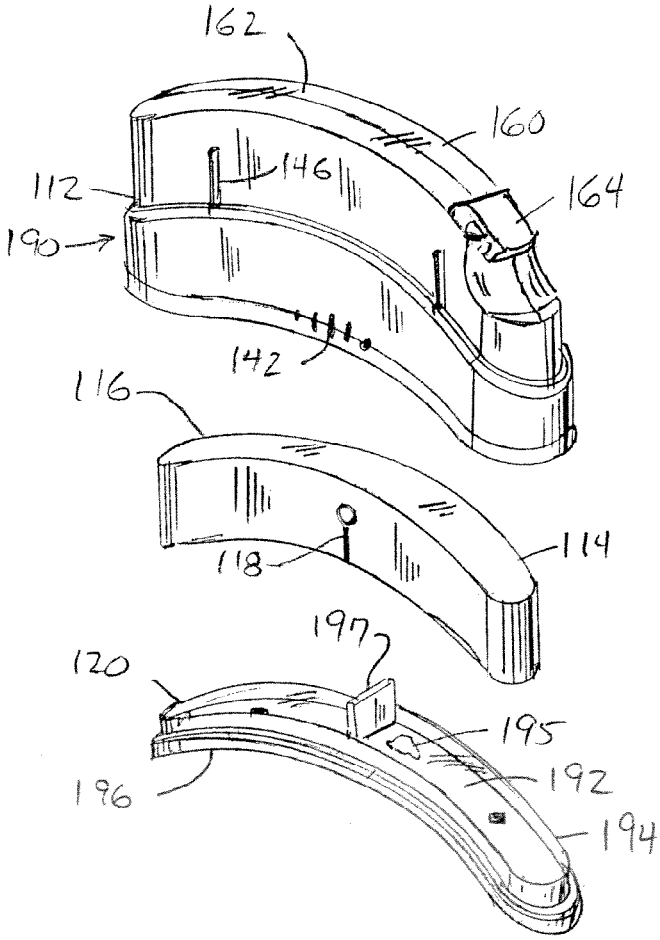
FIG. 27 is an exploded perspective view similar to FIG. 26 showing the components of the applicator or cleaner in FIGS. 17-26.
Figure 33:
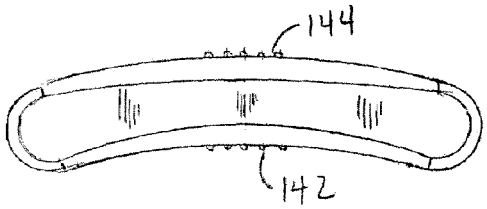
FIG. 33 is a top view of the stack of applicators or cleaners seen in FIGS. 29-32.

The unit 110 described above is manufactured by injection molding of the rigid components, namely, the two part applicator body 112 and the cap 170. With reference to FIGS. 27 and 25, the rigid body 112 comprises a first component 190 and a separate horizontal wall 120. The first component is a unitary injection molded part including the top wall 160, tab 164, upwardly extending wall 126 and skirt 122. It is continuous and, except for the bottom opening, water tight. The horizontal wall 120 is a unitary injection molded part having a central planar portion 192 surrounded by an upwardly extending flange 194 and an outwardly extending flange 196. A vertical stub 197 extends upwardly from the center of the central planar portion 192. The stub 197 is a short, flat stub extending transversely across the central planar portion 192. Two round bosses 198, 199, FIG. 32, extend downwardly from the bottom of the central planar portion 192, one on each side of the stub 197. These elements are assembled as follows: adhesive 195 is applied to the side of the horizontal wall 120 central planar portion 192 facing the foam body 114. The foam body, which has a transverse slit 118 across its center is brought into contact with the horizontal wall 120 and fixed to it by the adhesive 195. A charge of selected fluid 116 such as isopropyl alcohol, is charged into the foam body 114 or into the inverted first component 190. The horizontal wall 120 and foam body are inserted into the first component 190. The flanges 194,196 abut against ridges formed inside the first component where the upwardly extending wall 126 joins the skirt 122. The horizontal wall 120 is welded to the first component around its entire periphery sealing the upper compartment 128. The flanges 194, 196 provide necessary rigidity, surface area and mass for achieving a good welded seal. The foam body 114 and fluid 116 are thus sealed in the upper compartment and the fluid can not evaporate away.

The bosses 198, 199 provide an alternate filling method. The first component 190, foam body 114 and horizontal base wall 120 can be assembled without the fluid 116. After assembly and welding, fluid 116 can be injected through one of bosses 198, 199 while the other boss is penetrated with a venting needle. After charging of the compartment, the bosses are heat sealed, creating a fluid tight upper compartment 128. A completed unit 10 is thus manufactured.

Several of the units are then stacked as seen in FIG. 34 and packaged for sale or retail. Of course, fluids, gels and pastes other than cleaning fluids can be used. Surface treatments such as vinyl protectors, shoe polishes, topical medications, or other materials can be applied to the foam body 114 and sealed into the upper compartment 128. A clean, and if needed, sterile product applicator is provided in a convenient multiple unit package.

Figure 35:
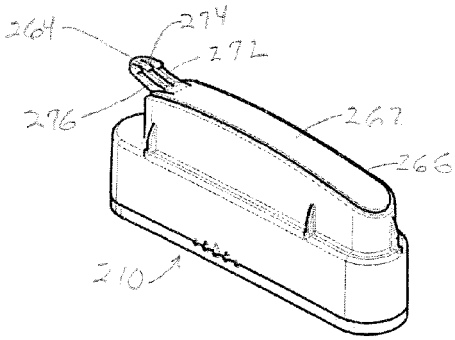
FIG. 35 is a perspective view of a stackable applicator or cleaner in accordance with another embodiment of the invention in the sealed configuration.
Figure 36:
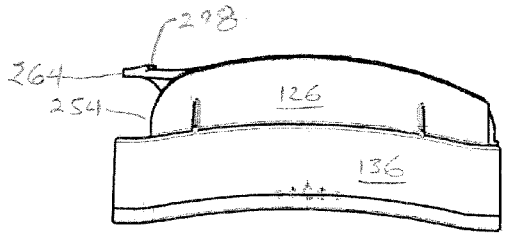
FIG. 36 is a side elevational view of the stackable applicator or cleaner as seen in FIG. 35.

Another embodiment of the applicator cleaner 210 is seen in FIG. 35. The applicator cleaner 210 is similar to the applicator cleaner 110 seen in FIGS. 17-34. Differences exist in the area of the tab 264 and the shoulder portion 254 under the tab.

Just as with the embodiment of FIGS. 17-34, the applicator cleaner 210 has an upwardly extending wall 126 and a downwardly extending wall 136. The upwardly extending wall 126 surrounds and defines an upper compartment. The upper compartment is closed at its bottom by the horizontal wall 120 as seen with respect to the prior embodiment. The top of the upper compartment is closed by a closure portion 262. The closure portion 262 is joined to the upwardly extending wall 126 by a thin web 266. The thin web 266 extends around the entire periphery of the closure portion 262. The upwardly extending wall 126, closure portion 262 and tab 264 are fabricated from a polymer material. The polymer material is select to provide a relatively rigid structure, but will allow separation at the thin web 266 when one peels back the closure portion 262.

Thus, the embodiment of the FIGS. 35-41 is very similar to the embodiment of FIGS. 17-34 in that that a compartment is defined within the upwardly extending wall 126 which holds a foam body which is in turn saturated with a cleaning agent. The downwardly extending wall 136 will surround and engage the upwardly extending wall 126 of an identical unit forming stack. The applicator cleaner 210 is opened by the consumer by grasping the tab 264 and using the tab to rupture the thin web 266 and separate the closure portion 262 from the applicator 210, cleaner readying it for use. The tab 264 is different from the tab 164 seen in the embodiment of FIGS. 17-34. The tab 264 includes three longitudinal ribs 272, 274, 276 extending upwardly from the tab's upper surface. The ribs are parallel to one another. The ribs strengthen and stiffen the tab 264. The ribs 272, 274, 276 are not of a uniform height. Rather, the inboard portions of the ribs adjacent the closure portion 62 are of a substantially uniform height for about two thirds of the length of the tab 264. A vertical step exists at the end of this uniform height portion increasing the height of the ribs. Outboard of the vertical step 278, the ribs' height lessens in a linear manner to the upward end of the tab 264. The vertical steps 278 are adjacent one another in the ribs 272, 274, 276.

Figure 37:
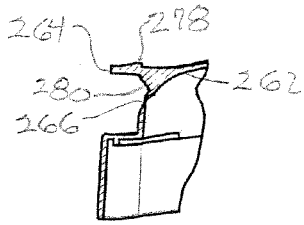
FIG. 37 is a cross sectional view of the tab and a portion of the applicator as seen in FIG. 36.
Figure 38:
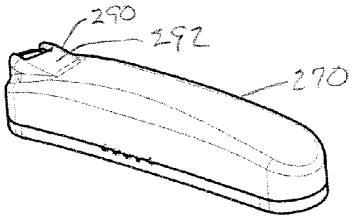
FIG. 38 is a perspective view of a cap used with the applicator or cleaner seen in FIGS. 35-37.
Figure 39:
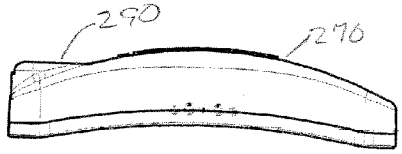
FIG. 39 is a side elevational view of the cap of FIG. 38.
Figure 40:
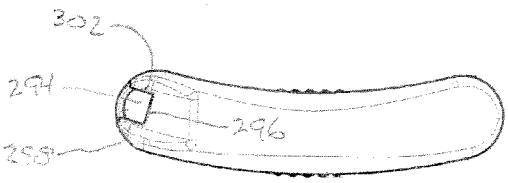
FIG. 40 is a top view of the cap seen in FIGS. 38-39.
Figure 41:
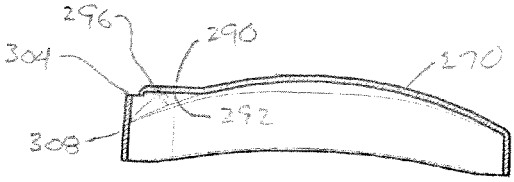
FIG. 41 is a cross section of the cap seen in FIG. 39.

As best seen in FIG. 37, a gusset 280 extends downwardly from the underside of the tab 264 to the closure portion 262. The gusset 280 is about as wide as one of the ribs 272, 274, 276. The gusset 280 rigidly connects the tab 264 to the closure portion 262 near the thin web 266. Thus, an upwardly directed force applied to the tab 264 is immediately transmitted through the gusset 280 and the closure portion 262 to the thin web 266.

The tab 264 is small. Some people may have difficulty manipulating it with their fingers. Therefore, the cap 270, seen in FIGS. 38-41, is provided with a structure to engage the tab 264. A shoulder 290 is provided at one end of the cap 270. This can be seen in FIGS. 39 and 41. The shoulder 290 has a substantially flat top wall 292 with a flat undersurface. An opening 294 is provided at the outboard end of the top wall 292. The opening 294 is defined by a straight inboard edge 296, a front straight edge 298 generally perpendicular to the inboard edge 296 and a rear straight edge 302 generally parallel to the front straight edge 298. As can best be seen in FIG. 41, the outboard edge of the opening 294 is in the side wall or skirt 308 of the cap 270. The outboard edge 304 is somewhat lower than the inboard edge 296 of the opening 294. The distance between the front straight edge 298 and rear straight edge 302 of the opening 294 is slightly greater than the width of the tab 264.

The cap 270 is used as removal tool for the closure portion 262 of an applicator cleanser 210. It must be remembered that the cap 270 is generally kept on top of the topmost applicator cleaner unit 210 and is therefore at hand when one wishes to use an applicator cleaner unit 210. The user removes the cap 270 and inverts it. The cap is then slide into engagement with the tab 264 by passing the tab 264 through the opening 294. The flat underside of the top wall 292 engages the underside of the tab 264. The user then rotates the cap 270. This applies an upward force on the tab 264 through the top wall 292. The cap is kept from disengaging from the tab 264 by means of engagement of the outboard edge 304 with the vertical steps 278 in the ribs 272, 274, 276. The steps 278 are a vertical surface. They will bear against the outboard edge 304 of the opening 294 preventing the cap from sliding off the tab 264. The user therefore can use the cap as a lever lifting the tab 264 thus breaking the thin web 266 and continuing to rotate the cap 270 to remove the closure portion 262. This opens the applicator cleaner 210 and allows the foam body containing cleaning material to expand upwardly from the compartment in a ready to use configuration. The user then cleans the surface desired, removes the top most cleaner unit from the stack of cleaner units and applies the cap 270 to the next succeeding unit and puts the ensemble away.

The tab 264 is sized to fit within either the skirt 136 of an identical applicator cleaning unit 210 or within the cap 270. As the cap is always on top of the top most applicator cleaner unit 210, a removal tool to use as a lever is always available for opening the applicator cleaner when desired.

While considerable emphasis has been placed herein on the structure of the preferred embodiments and the structural interrelationships between component parts of the preferred embodiments, it will be appreciated that many changes in these embodiments herein illustrated and described can be made without departing from the principles of the invention. Accordingly, it is to be distinctly understood that the foregoing descriptive matter is to be interpreted merely as illustrative of the preferred embodiments and not as a limitation.

Having thus described the invention, it is claimed:

1. A multiple unit applicator product comprising:

several identical self-contained sealed applicator units;

each applicator unit comprising a rigid body comprising:

a base wall, a skirt extending downwardly from said base wall, at least one upper side wall extending upwardly from said base wall having a top edge, said at least one upper side wall and said base wall defining an upper compartment having an openable top, said skirt and said base wall defining a lower compartment having an open bottom;

a compressible foam body received in said upper compartment, said foam body extending above said at least one upper side wall top edge when in an uncompressed and use state;

a quantity of fluid or gel absorbed in said foam body;

a sealing top fixed to said at least one upper side wall top edge compressing said foam body below said upper side wall top edge into said upper compartment and sealing said upper compartment prior to use, said top including a rigid tab extending from said top; and, said skirt surrounding and engaging the upper side wall of another identical self-contained sealed applicator unit.

2. The multiple unit applicator product of claim 1, further comprising a cap including a top wall and a cap skirt extending downwardly from said top wall, said top wall and said cap skirt defining a cap compartment having an open bottom, said cap skirt being adapted to surround and engage the upper side wall of one of said applicator units whereby said several identical self-contained applicator units are compactly stacked and the top most applicator unit is covered by said cap.

3. The multiple unit applicator product of claim 2, wherein said cap top wall is generally flat.

4. A stackable applicator comprising:

an applicator including a rigid applicator body comprising a base wall permanently welded into said applicator body, a skirt extending downwardly from said base wall, at least one upwardly extending side wall extending upwardly from said base wall having a top edge, a removable top removably fixed to said side wall around said entire top edge, said base wall, side wall and top defining an upper compartment openably sealed by said removable top and said base wall and said skirt defining a lower compartment, a compressible foam body contained in said upper compartment wherein said compressible foam body is compressed and hermetically sealed in said upper compartment below said upper side wall top edge when said removable top is in place; a quantity of fluid absorbed in said foam body, and, said applicator body lower compartment being adapted to receive said upper compartment of an adjacent self-contained applicator whereby said applicator is stacked with at least another self contained identical applicators prior to use in a package state and separated from the stack in a use state.

5. The stackable applicator of claim 4, wherein removal of said removable top creates a top opening in said upper compartment and said compressible foam body extends through said top opening.

6. The stackable applicator of claim 4, wherein said compressible foam body have a bottom surface and said compressible foam body bottom surface is fixed to said base wall.

7. The stackable applicator of claim 4, wherein said rigid body have two long arcuate generally parallel sides and two ends connecting said sides.

8. The applicator of claim 7, wherein said rigid body have a shoulder in one of said ends and said top have a first end and a tab extending from said first end, said tab disposed adjacent said shoulder and adapted to be grasped by a user such that the user removes said top in the use state.

9. A multiple unit applicator product comprising:

several identical self-contained sealed applicator units, each applicator unit comprising a rigid body including a continuous base wall, a skirt extending downwardly from said base wall, at least one upper side wall extending upwardly from said base wall having a top edge, a top removably fixed to said side wall around said top edge, said top including a sealing film having a rigid tab extending from said sealing film adjacent said top edge, said at least one upper side wall, said base wall and said top defining an upper compartment selectively closed by said removable top, said skirt and said base wall defining a lower compartment having an open bottom;

a compressible foam body received in said upper compartment, said foam body adapted to extend above said at least one upper side wall top edge when in an uncompressed state or be contained in said upper compartment in a compressed state;

a quantity of fluid or gel absorbed in said foam body;

said compressible foam body hermetically sealed by said sealing film in said compressed state; and, said skirt surrounding and engaging the upper side wall of another identical self-contained rigid applicator.

10. The multiple unit applicator product of claim 9, further comprising a cap, said cap including a cap top wall and a cap skirt extending downwardly from said cap top wall, said cap top wall and said cap skirt defining a cap compartment having an open bottom, said cap skirt being adapted to surround and engage the upper side wall of one of said applicator units whereby several applicator units may be compactly stacked and the top most applicator unit is covered by said cap.

11. The multiple unit applicator product of claim 10, wherein said cap top wall is generally flat.

12. The multiple unit applicator product of claim 9, wherein said top, said at least one upper side wall, and said skirt are a unitary molded structure.

13. The multiple unit applicator product of claim 12, wherein said base wall is welded into said unitary molded structure.

14. A stackable product applicator comprising:

a self-contained applicator having a rigid body comprising a continuous base wall fixed into said rigid body, a skirt extending downwardly from said base wall, at least one upper side wall extending upwardly from said base wall having a top edge, a top removably fixed to said side wall around said entire top edge, said at least one upper side wall, said base wall and said top defining an upper compartment having an openable closed top;

said skirt and said base wall defining a lower compartment having an open bottom;

a compressible foam body received in said upper compartment, said foam body adapted to extend above at least one upper side wall top edge when in an uncompressed state and be contained in said upper compartment in a compressed state;

a quantity of fluid or gel absorbed in said foam body;

said skirt being adapted to surround and engage an upper side wall of another identical applicator whereby several identical self-contained applicators are compactly stacked; and, wherein said base wall have at least one boss adapted to allow injection of fluid into said upper compartment.

15. The product applicator of claim 14, wherein said base wall is fixed into said rigid body by welding.

16. The product applicator of claim 14, wherein said foam body have a bottom surface and said foam body bottom surface is adhered to said upper compartment.

17. The product applicator of claim 14, wherein said rigid body have two long arcuate generally parallel sides and two ends connecting said sides.

18. The applicator of claim 14, wherein said rigid body have a shoulder in one end and said top have a tab extending beyond said top edge adjacent said shoulder.

19. A method of making an applicator product comprising the steps of:

providing an applicator body first component comprising at least one upper side wall, a skirt and an openable closed top including a sealing film;

providing a compressible foam body;

providing a quantity of fluid;

providing a base wall;

assembling said applicator body first component, said compressible foam body, said quantity of fluid and said base wall creating a self-contained said applicator product such that said foam body and said fluid are hermetically sealed in an openable closed upper compartment defined by said upper side wall, said top and said base wall with said foam body in a compressed state; and, said skirt and said base wall define a lower compartment and a plurality of identical self-contained said applicator products are stacked prior to use with the upper compartment of at least one of said applicator products received in said lower compartment of another identical adjacent applicator product creating a stack of applicator products.

20. The method of claim 19, wherein said base wall is welded to said body first component.

21. The method of claim 20, wherein a cap is applied to a top most applicator product of said stack.

22. The multiple unit applicator product of claim 1, wherein each said identical self-contained sealed applicator unit is a single use disposable applicator.

23. The multiple unit applicator product of claim 4, wherein each said identical self-contained sealed applicator unit is a single use disposable applicator.

24. The multiple unit applicator product of claim 21, wherein each said identical self-contained sealed applicator unit is separated for said use and disposed of after said use.

25. A method of making an applicator product comprising the steps of:

providing an applicator body first component comprising at least one upper side wall, a skirt and an integrated openable closed top including a sealing cover;

providing a quantity of fluid into said applicator body first component;

providing a compressible foam body having a base wall thereunder;

assembling said applicator body first component and said quantity of fluid with said compressible foam body and said base wall creating a self-contained said applicator product such that said foam body and said fluid are hermetically sealed in an openable closed upper compartment defined by said upper side wall, said top and said base wall with said foam body in a compressed state; and, creating a stack of applicator products wherein said skirt and said base wall define a lower compartment and a plurality of identical self-contained said applicator products are stacked prior to use with the upper compartment of at least one of said applicator products received in said lower compartment of another identical adjacent applicator product.

* * * * *